United States Patent [19]

Meador

[11] 3,999,539

[45] Dec. 28, 1976

[54] WATER FILLED ORTHOPEDIC CHAIR

[76] Inventor: Robert L. Meador, 1767 Sumac Lane No. A, Anaheim, Calif. 92804

[22] Filed: Dec. 10, 1975

[21] Appl. No.: 639,258

[52] U.S. Cl. ..... 128/24.2; 128/33; 128/24 R; 297/260

[51] Int. Cl.[2] ..... A61H 21/00

[58] Field of Search ..... 128/24 R, 33, 24.1, 128/24.2, 44–52, 64; 297/260

[56] References Cited

UNITED STATES PATENTS

| | | | |
|---|---|---|---|
| 2,245,909 | 6/1941 | Enfiajian | 128/24.2 UX |
| 2,715,901 | 8/1955 | Blake | 128/24 R |
| 2,874,689 | 2/1959 | Gavelek | 128/24 R |
| 2,915,055 | 12/1959 | Matton | 128/24 R |
| 3,013,281 | 12/1961 | Steiner | 128/24 R |
| 3,019,052 | 1/1962 | Zawadzki | 128/24 R |

*Primary Examiner*—Lawrence W. Trapp
*Attorney, Agent, or Firm*—William C. Babcock

[57] ABSTRACT

A contour chair, mounted for powered articulation on a pedestal, which includes a plurality of transversely aligned flexible containers disposed over the support surface thereof, each container communicating across a corresponding check valve with a common manifold. The other end of the manifold is connected to a pressurized source of water whereby an even distribution of surface pressure is achieved in the support surface of the chair. To provide for retention of a person seated in the chair during the articulation thereof on the pedestal, there is included on the back support area thereof a neck brace adjustable to accommodate various sized torsos. Included further with the chair are two arm rests, one provided with the requisite control buttons for articulating the chair, and the other being hinged to allow convenient ingress and egress onto the chair.

7 Claims, 8 Drawing Figures

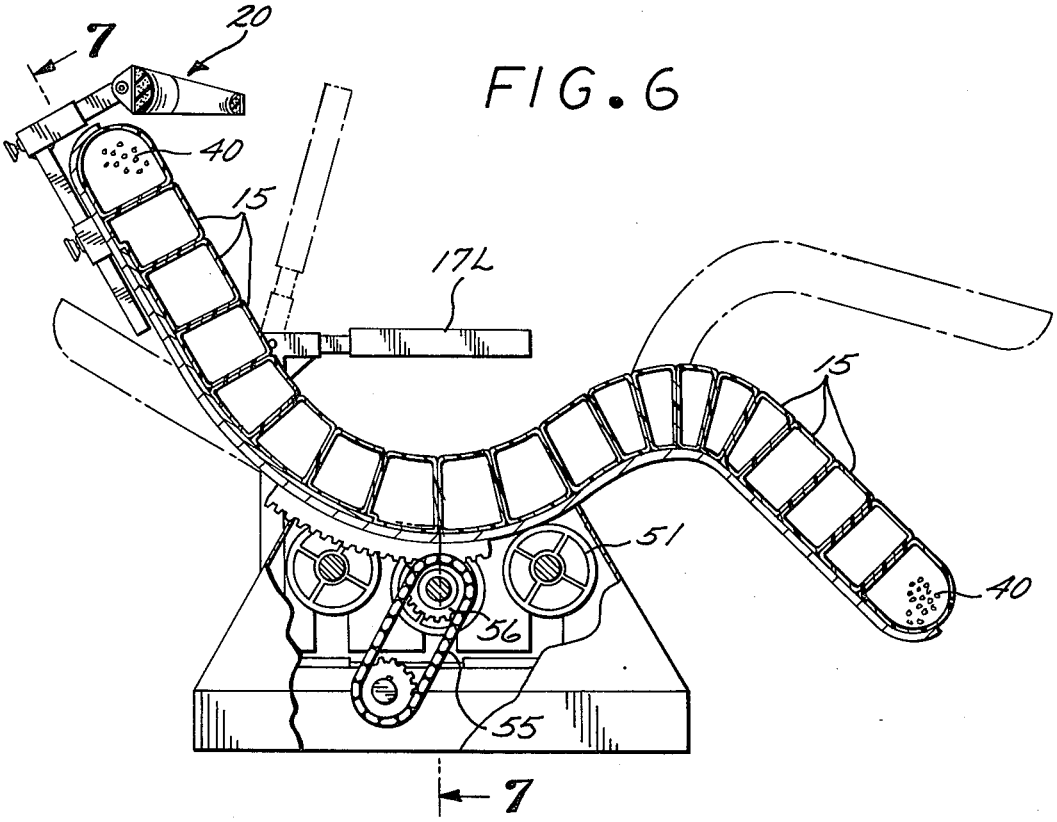
FIG. 6
FIG. 7
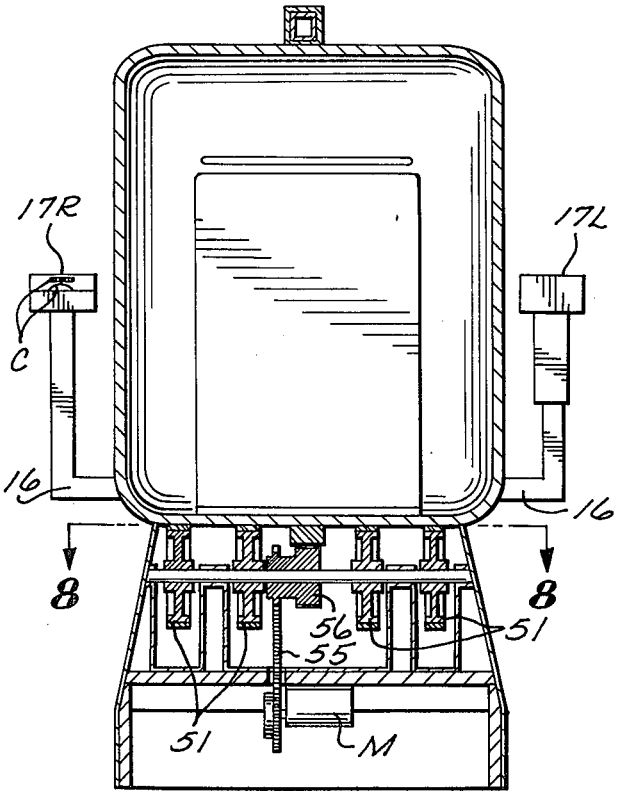
FIG. 8
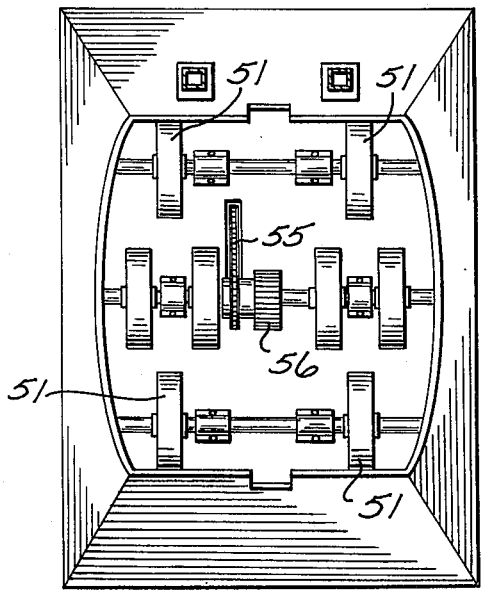

WATER FILLED ORTHOPEDIC CHAIR

BACKGROUND OF THE INVENTION

1. Field of the Invention

The present invention relates to chair fixtures, and more particularly to water filled orthopedic chairs adapted for mechanical articulation.

2. Description of the Prior Art

Contour chairs articulated as a single unit or in sections have been known in the past. Generally however, such chairs, while possibly adapted for a single use, are not capable of accommodating various persons and particularly a variety of patients having a broad spectrum of differing infirmities. For example, in orthopedic work and osteopathic examination, the examining physician has to accommodate various unique injuries with a sufficient degree of comfort to complete either the diagnostic or the treatment process. One manner of achieving a certain degree of comfort is by constructing the support surface of the chair to obtain an even load distribution thereover. Once such load distribution is achieved, there still remains the problem that certain manipulations of the patient's body by the physician are necessary in order to complete most of the common examination routines.

Generally, when a patient seeks the assistance of a physician, and particularly an orthopedic physician, it is as a result of pain thus presenting the physician with the problem of immediately alleviating such pain or at least to reduce any potential of aggravating the injury. Often, however, such injury is chronic in character and even outside of treatment by a physician, means for supporting such an injury in a comfortable manner are required.

SUMMARY OF THE INVENTION

Accordingly, it is the general purpose and object of the present invention to provide a contoured chair having a support surface which can be controlled in the degree of compressibility thereof.

Further objects of the invention are to provide a contoured chair which can be articulated to any angular relationship relative a horizontal.

Yet further objects of the invention are to provide a chair adapted to accommodate various injuries in a patient.

Briefly these and other objects are accomplished within the present invention by forming a support frame for a contoured chair in a manner of a shell having a sectional shape generally conformed to the shape of an "S" with the central radius of the "S" or the area subjacent the lower torso of the patient being supported on rollers for articulation. To achieve such articulation there is provided further, on the back surface of the lower torso arc, an arcuate rack which is disposed to engage a pinion gear extending from an electric motor. In this manner, the angular orientation of the chair can be controlled by the forward or reverse rotation of the electric motor. Disposed on the face of the chair or on the supporting surface thereof, is a peripheral strip either foam-filled or actually liquid filled, having arranged transversely therebetween a plurality of lateral segments. Each lateral segment is formed in a manner of a flexible bag communicating with a manifold across a corresponding check valve. The manifold is then connected to a source of pressurized liquid or water and after the patient is positioned in the chair, any desired level of water pressure can be applied to the interior of each segment. In this manner, a generally even distribution of load occurs over the surface of the chair reducing any discomfort to the patient.

BRIEF DESCRIPTION OF THE DRAWING

FIG. 6 is a side view in partial cross section of the chair shown in FIG. 1;

FIG. 7 is a sectional rear view taken along line 7—7 of FIG. 6; and

FIG. 8 is a sectional top view taken along line 8—8 of FIG. 7.

DESCRIPTION OF THE SPECIFIC EMBODIMENT

While the following disclosure is made with reference to a unitary contoured chair, such is for purposes of illustration only. It is to be understood that the features embodied herein may be useful in applications differing than those shown and no intent to limit the invention by way of this disclosure is therefore expressed.

Figure 1:
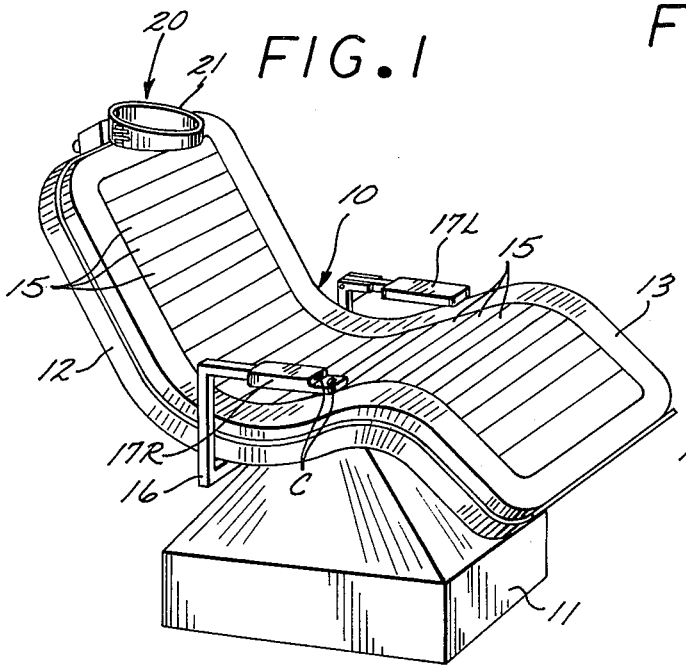
FIG. 1 is a perspective illustration of a chair constructed according to the present invention.
Figure 2:
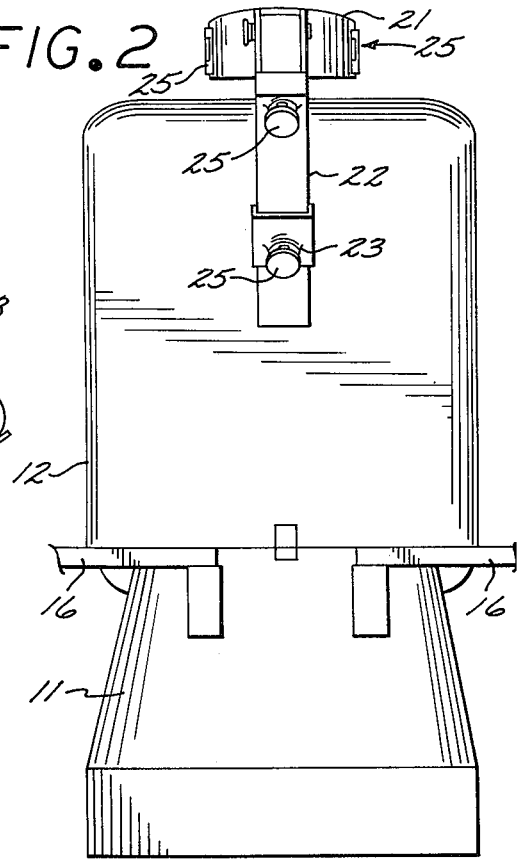
FIG. 2 is a rear view of the chair shown in FIG. 1.
Figure 3:
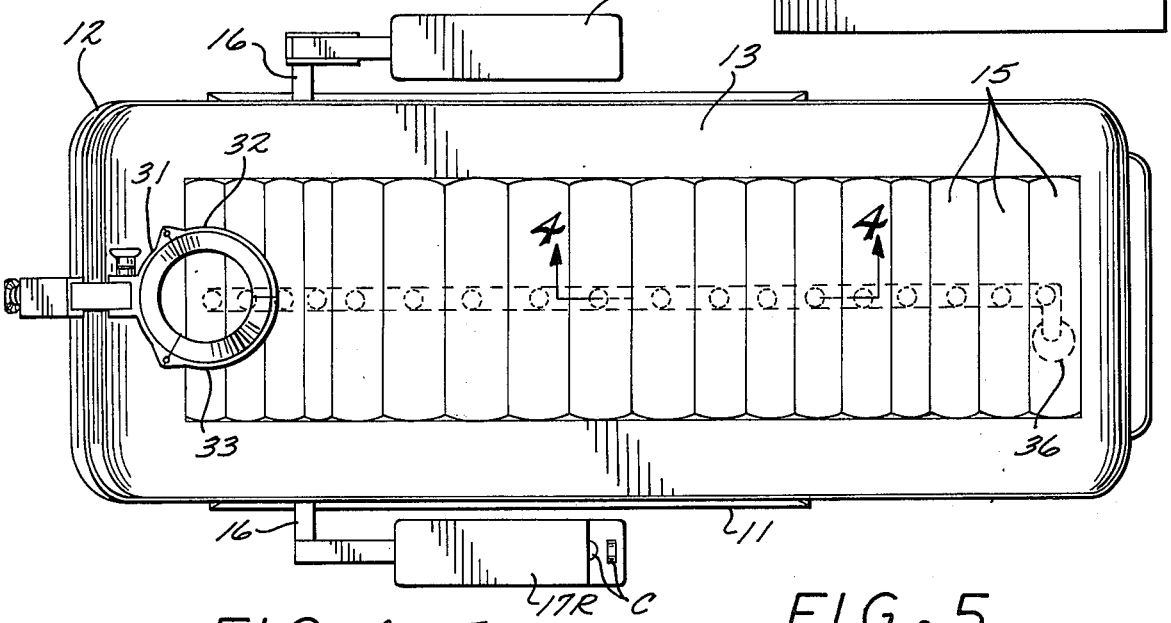
FIG. 3 is a top plan view of the chair shown in FIG. 1.

As shown in FIGS. 1, 2 and 3, an orthopedic chair generally designated by the numeral 10, comprises a pedestal 11 supporting the underside of a convolved sheet back frame 12 having arranged on the face thereof a peripheral strip 13 deformable transversely and extending exteriorly beyond the edges of the frame. Disposed transversely across the support face of chair 10, within the opening in the peripheral strip 13, are a plurality of lateral segments 15 forming the support cushion for the patient resting on the chair. Extending from the rear surface of pedestal 11 along the underside of frame 12, are two arm support frames 16, respectively terminating in a left and right arm support 17L and 17R. To provide for a convenient egress and ingress, the left arm rest 17L is pivotally fixed to the free end of frame 16, allowing for an upward and rearward articulation thereof to open that side of the chair. Arm rest 17R, on the other hand, is fixed in its relationship with respect to the chair, providing a plurality of control knobs C whereby the articulation of the chair relative the pedestal can be achieved.

The position of the patient in the chair is further secured by way of a neck brace assembly 20 comprising a circular neck clamp 21 releasably attached to a frame 22 which, in turn, is secured by way of a sliding engagement to a bracket 23 on the rear of frame 12. To allow for adjustment of frame 22 relative the bracket 23, there are a plurality of securing knobs 25 which, by way of threadable engagement secure the neck brace assembly at various orientations relative the chair. Clamp 21 is generally circular in section including a cushioning liner 26 on the interior thereof. To achieve an opening arrangement in clamp 21, the structure thereof comprises three segments 31, 32 and 33, segment 31 attaching to the frame 22 to pivotally connect to the corresponding ends of segment 32 and 33. In this form, any conventional spring biasing mechanism may be utilized to maintain the clamp 21 closed once the patient is properly positioned.

Figure 4:
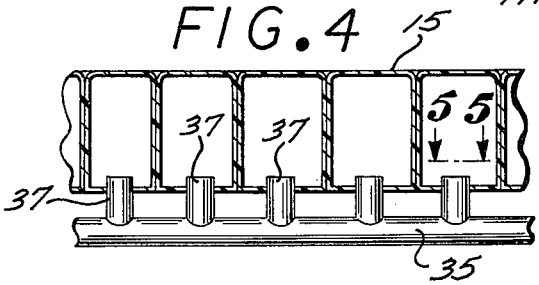
FIG. 4 is a partial sectional view taken along line 4—4 of FIG. 3.

As shown in FIGS. 3 and 4, each lateral segment 15 comprises a flexible enclosure generally rectangular in shape, having the longitudinal dimension thereof bounded by the opening within the peripheral strip 13 while the lateral dimensions thereof are determined by the adjacent segments. Communicating with the interior of each segment 15 is a common manifold 35 disposed in the interface between the segments and the subjacent surface of frame 12. Manifold 35 in turn connects across a valve 36 to a source of pressurized liquid (not shown) whereby the individual segments can be filled to any desired level of internal pressure.

Figure 5:
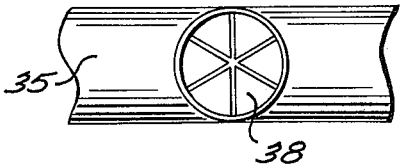
FIG. 5 is a partial sectional view taken along line 5—5 of FIG. 4 illustrating a leaf check valve useful with the present invention.

As shown in FIGS. 4 and 5, manifold 35 includes a plurality of communicating ports 37 which extend across the surface of segment 15 to thus direct the flow of fluid into the interior thereof. Each port 37 furthermore includes a leaf check valve 38 biased to oppose any fluid return as a result of pressure increases exerted by the torso. Check valve 38, in particular, comprises a plurality of leaf segments 39 having contiguous edges formed along common radii of a circle, leaves 39 being formed again of a flexible structure to allow for evacuation of the segments above a predetermined pressure differential. In this manner, each segment is filled by the liquid to a predetermined level of pressure and the small variations in the segment pressure resulting from the weight of the torso will be retained by the check valve 38. Once the pressure source, however, is removed from the valve 36, the large opposed bias pressure differential across the check valve will permit partial evacuation thereof, thus allowing for a pressure adjustment to accommodate various patients.

As shown in FIG. 6, the peripheral strip 13 may include a foam rubber filling 40, thus providing the protective function during ingress and egress rather than any support function. The peripheral strip 13, as well as the individual segments 15, each comprise an enclosure formed by convolving a flexible sheet of plastic. Since it is intended to inject a liquid like water through manifold 35 into segments 15 and since very often the source of such liquid may be at temperatures which are uncomfortable to the patient, there is further provided within the frame 12 a heating pad 45 having disposed adjacent thereto a temperature sensing strip 46. This arrangement of parts forming the frame and cushioning surface of the chair 10 is, in turn, supported on a plurality of rollers 51 within the interior of pedestal 11.

More specifically as shown in FIGS. 6, 7 and 8, the frame 12 is generally convolved within the section subjacent the lower torso of the patient along the radius of a circle straddling the respective rollers 51. Rollers 51 are mounted on a plurality of corresponding transverse roller shafts 52 extending across the pedestal and are thus free in rotation, allowing for the angular articulation of the frame 12 relative the pedestal 11. To reduce the noise and the bounce due to surface irregularities in the frame 12, each roller 51 is provided with a peripheral rubber strip 53 on which the frame 12 translates. A reversible electric motor M through a chain drive 55, in turn, articulates a pinion gear 56 mounted for rotation on one of the roller shafts 52, gear 56 engaging, in turn, an arcuate rack segment 57 on the underside of frame 12. The direction of articulation achieved in this manner can then be controlled by selectively controlling the direction of rotation of the motor through the control knob C on the right arm rest 17R.

Some of the many advantages of the present invention should now be readily apparent. The invention provides, by way of a convenient arrangement of parts, a chair assembly which is comfortable in use, can accommodate various patients and which can be adjusted to various levels of spring constant over the support surface thereof. This the invention provides in conjunction with a powered articulation mechanism whereby the alignment of the chair can be easily manipulated.

Obviously many modifications and variations will become obvious to those skilled in the art from the above teachings. It is therefore intended that the scope of the invention herein be solely limited by the claims appended hereto.

I claim:

1. A contoured chair assembly comprising:

a convolved shell frame formed to provide a supporting surface for a person and including a transverse surface of revolution section over the central portion thereof;

a support pedestal;

a plurality of transverse rollers disposed across the top surface of said pedestal and arranged to support said section at selected tangent points thereof;

an arcuate rack mounted in a longitudinal plane relative said frame to extend radially on the exterior of said section;

drive means engaging said rack for tangentially advancing said section over said rollers;

a peripheral flexible strip disposed along the edges of said frame on the supporting surface thereof;

a plurality of elongate flexible containers disposed between the opposite sides of said peripheral strip; and manifold means arranged between said flexible containers and said frame and connected to said containers for supplying thereto a liquid at predetermined pressures.

2. Apparatus according to claim 1 further comprising:

electrical heating means disposed between said frame and said containers for maintaining the temperature of said liquids therein at a preselected level.

3. Apparatus according to claim 2 wherein:

said manifold means includes a plurality of parts communicating with said containers, each part including a leaf valve adapted to oppose the return of said liquid therefrom.

4. Apparatus according to claim 3 further comprising:

an adjustable neck brack disposed from one end of said frame for releasably retaining the neck of a person positioned on said frame.

5. Apparatus according to claim 4 wherein:

said peripheral strip comprises a flexible toroidal enclosure containing a foam rubber filler.

6. Apparatus according to claim 5 wherein:

said containers each comprise a sheet plastic envelope closed on all surfaces and pierced by selected ones of said ports.

7. Apparatus according to claim 6 wherein:

said drive means includes an electric motor connected to rotate a pinion gear which is arranged for meshing engagement with said rack.

* * * * *